US007721725B2

(12) United States Patent
Charleston et al.

(10) Patent No.: US 7,721,725 B2
(45) Date of Patent: May 25, 2010

(54) METHOD AND APPARATUS FOR HEATING GOLF BALLS

(75) Inventors: Christopher Charleston, Buzzards Bay, MA (US); Thomas Edward Moore, Warren, RI (US); Robert Gell, Somerset, MA (US)

(73) Assignee: Acushnet Company, Fairhaven, MA (US)

( * ) Notice: Subject to any disclaimer, the term of this patent is extended or adjusted under 35 U.S.C. 154(b) by 3 days.

(21) Appl. No.: 10/915,457

(22) Filed: Aug. 11, 2004

(65) Prior Publication Data

US 2006/0032078 A1 Feb. 16, 2006

(51) Int. Cl.
*F24C 15/32* (2006.01)

(52) U.S. Cl. ..... 126/21 A; 99/443 C; 126/1 AD; 126/19 R

(58) Field of Classification Search ..... 126/21 A
See application file for complete search history.

(56) References Cited

U.S. PATENT DOCUMENTS

| | | | | |
|---|---|---|---|---|
| 1,602,048 | A | | 10/1926 | Seibel |
| 2,640,412 | A | | 6/1953 | Sweger |
| 2,714,808 | A | | 8/1955 | Owen et al. |
| 2,730,866 | A | | 1/1956 | Baker et al. |
| 2,807,992 | A | | 10/1957 | Ehman |
| 2,909,112 | A | | 10/1959 | Yousoufian |
| 3,308,741 | A | | 3/1967 | Chambers |
| 3,452,447 | A | | 7/1969 | Gardner |
| 3,570,385 | A | | 3/1971 | Heisterkamp et al. |
| 3,780,503 | A | | 12/1973 | Smith |
| 3,818,815 | A | | 6/1974 | Day |
| 3,823,488 | A | | 7/1974 | Houben et al. |
| 3,835,759 | A | | 9/1974 | Lloyd |
| 3,948,155 | A | | 4/1976 | Hedrick |
| 3,957,187 | A | | 5/1976 | Puigrodon |
| 3,979,038 | A | | 9/1976 | Karlsson |
| 4,039,278 | A | * | 8/1977 | Denholm ..... 432/144 |
| 4,085,522 | A | | 4/1978 | Stroszynski |
| 4,316,406 | A | | 2/1982 | Lind |
| 4,319,520 | A | | 3/1982 | Lanting et al. |
| 4,366,525 | A | | 12/1982 | Baumgartner |
| 4,407,187 | A | | 10/1983 | Horney |
| 4,484,063 | A | * | 11/1984 | Whittenburg et al. ..... 219/400 |
| 4,501,533 | A | | 2/1985 | Bower, Jr. |
| 4,722,683 | A | * | 2/1988 | Royer ..... 432/152 |
| 4,726,685 | A | | 2/1988 | Kobayashi et al. |

(Continued)

*Primary Examiner*—Steven B McAllister
*Assistant Examiner*—Sarah Suereth
(74) *Attorney, Agent, or Firm*—Hanify & King, P.C.

(57) ABSTRACT

A method and apparatus for heating golf balls or golf ball components is disclosed. The apparatus includes a housing that includes a back panel comprising a plurality of slots. The slots are preferably formed such that they are parallel to a plurality of trays of golf balls. The housing also includes a front panel that includes a plurality of openings that are substantially perpendicular to the trays of golf balls. The size of each of the plurality of openings may be varied based on a plurality of adjustable panels. Each of the adjustable panels may be capable of completely sealing an opening or being displaced to completely prevent obstruction of the opening. Heated air is preferably supplied via an air supply plenum that is capable of supplying air in a direction that is perpendicular to the back panel. The method and apparatus allow the interior of the housing to maintain a desired temperature differential and allow the rate of air flow to be manipulated.

57 Claims, 6 Drawing Sheets

U.S. PATENT DOCUMENTS 4,869,155 A 9/1989 Grieve
4,892,030 A 1/1990 Grieve
4,940,040 A * 7/1990 Randall et al. ..... 126/21 A
5,035,067 A 7/1991 Bergquist et al.
5,069,198 A 12/1991 Henderson
5,180,898 A * 1/1993 Alden et al. ..... 219/388
5,276,309 A 1/1994 Hasse et al.
5,297,234 A 3/1994 Harms et al.
5,361,686 A 11/1994 Koopman
5,451,744 A 9/1995 Koopman et al.
5,683,604 A 11/1997 Ubert et al.
5,693,242 A * 12/1997 Sanchez ..... 219/400
5,785,612 A * 7/1998 Shapiro et al. ..... 473/377
5,816,234 A * 10/1998 Vasan ..... 126/21 A
5,918,589 A 7/1999 Valle et al.
6,245,386 B1 * 6/2001 Felker et al. ..... 427/258
6,338,303 B1 1/2002 Zoellner
6,755,912 B2 * 6/2004 Brown et al. ..... 118/500
6,870,136 B1 * 3/2005 Majordy ..... 219/400

* cited by examiner

METHOD AND APPARATUS FOR HEATING GOLF BALLS

FIELD OF THE INVENTION

The present invention relates to golf ball curing and drying. More specifically, the present invention relates to an improved method and apparatus for curing and drying a dense population of golf balls.

BACKGROUND OF THE INVENTION

Golf balls are manufactured using a myriad of processes and apparatus. Typically, the golf ball manufacturing process is chosen according to the composition of the golf ball. For example, golf balls may be manufactured using one or more solid pieces, windings, or even liquid cores. Additionally, the golf ball may include many types of covers, which may be placed around a golf ball core using a number of processes, such as Retractable Pin Injection Molding (RPIM) and the like. Often, golf balls are painted or have logo's imprinted onto their surface.

Depending on the method or apparatus used to manufacture a golf ball, it may be desirable to dry the golf ball. This may be necessary, for example, to cure different golf ball components or to ensure that paint applied to the golf ball dries uniformly within a reasonable time period. Prior art apparatus have involved moving trays of golf balls through a housing through which heated air flows. The heated air aids in drying and/or curing the golf balls.

One type of prior art drying apparatus involved heating air, and then directing the air through a header. Air from the header was then fed into a housing, in which the golf balls are located. However, these apparatus often had several disadvantages. For example, the volume of air that flows over the golf balls differs between the bottom of the housing and the top of the housing. This is because the air is typically fed into the header from near the bottom. Another disadvantage caused by the location of the air source is that the temperature of the air differs between the bottom and the top of the housing. The temperature differential may result in uneven drying and/or curing speeds.

A continuing need exists for an apparatus and method that are capable of drying and/or curing golf balls uniformly.

BRIEF DESCRIPTION OF THE DRAWINGS

Further features and advantages of the invention can be ascertained from the following detailed description that is provided in connection with the drawings described below.

SUMMARY OF THE INVENTION

Figure 1A:
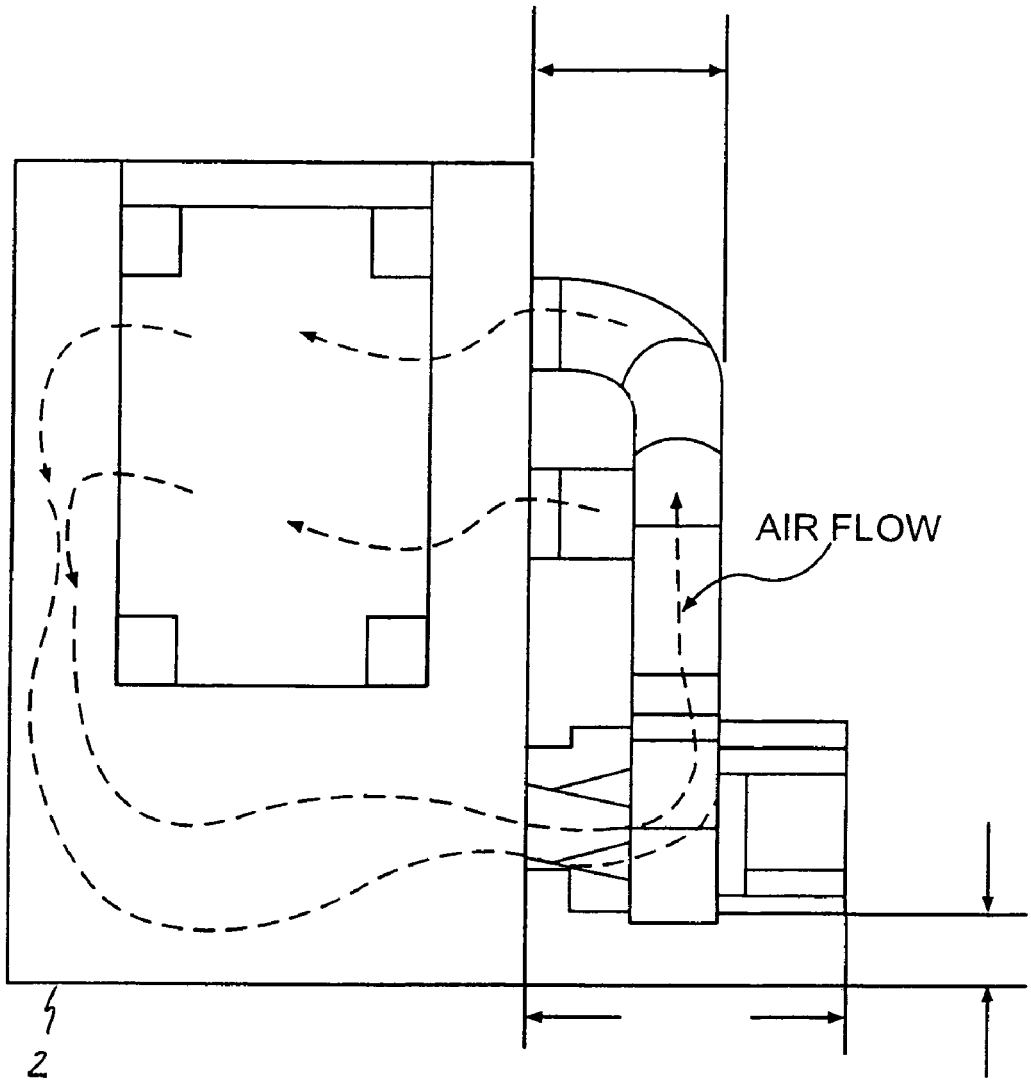
FIGS. 1A-1B are diagrams showing an overview of one embodiment of the present invention.

The present invention provides an apparatus and method for achieving a consistent temperature for drying or curing golf balls positioned with a housing. In addition, the present invention is capable of providing a substantially uniform airflow over the golf balls. One advantage of the present invention is that the apparatus is capable of curing and drying a dense population of golf balls with improved speed. Another advantage of the present invention is that the consistency of curing from ball to ball across a large matrix of closely oriented golf balls is improved over prior art apparatus and methods. Additionally, the air flow within the housing of the present invention may be adjusted through the use of adjustable panels. In this manner, the temperature throughout the housing may be varied, or balanced, as desired.

In one embodiment, the present invention comprises an apparatus for heating golf balls that comprises a first panel comprising a plurality of slots. The width of the slots preferably increases incrementally from a first end of the panel to a second end of the panel. The apparatus also includes a second panel comprising a plurality of openings. The size of the plurality of openings is capable of being adjusted. Also included is an air supply capable of providing air in a direction substantially perpendicular to the first panel.

The plurality of slots are substantially parallel to a plurality of trays. Preferably, the length of the plurality of slots is about 20" or greater. More preferably, the length of the plurality of slots is about 25" or greater. In one embodiment, the plurality of slots includes a lowest slot, whose height is between about 0.400" and about 0.600". More preferably, the height of the lowest slot is between about 0.500" and about 0.560". The plurality of slots may also include a top slot positioned substantially near the second end of the panel. The height of the top slot is preferably between about 0.700" and about 1.4". More preferably, the height of the top slot is between about 0.900" and about 1.2".

In some embodiments, the size of the plurality of openings are capable of being adjusted based on a plurality of adjustable panels. Preferably, the width of the plurality of openings is between about 1" and about 8". More preferably, the width of the plurality of openings is about 3" or greater. The length of each of the plurality of openings may preferably be between about 12" and about 25". More preferably, the length of each of the plurality of openings may be about 15" or greater.

In one embodiment, the first and second panel are included in a housing that is capable of passing about 1000 or more cubic feet of air per minute. More preferably, the housing is capable of passing about 1500 or more cubic feet of air per minute. It may be desirable for the plurality of openings to be substantially perpendicular to the plurality of slots. The present invention further comprises an air supply capable of providing air in a direction substantially perpendicular to the first panel. In some embodiments, the apparatus may further comprise a chamber surrounding the housing.

In another embodiment, the present invention comprises an apparatus for heating golf balls. The apparatus comprises a first panel comprising a plurality of slots substantially parallel to a plurality of trays. The width of the plurality of slots increases incrementally from a first end of the panel to a second end of the panel. Also included is a second panel comprising a plurality of adjustable openings substantially perpendicular to the plurality of slots and an air supply capable of providing air in a direction substantially perpendicular to the first panel.

In one embodiment, the length of the plurality of slots is preferably between about 20" and about 30". More preferably, the length of the plurality of slots is between about 15" and about 35". The plurality of slots preferably includes a lowest slot positioned substantially near the first end of the panel whose height is between about 0.400" and about 0.600". More preferably, the height of the lowest slot is between about 0.520" and about 0.540".

In one embodiment, the plurality of slots includes a top slot positioned near the second end of the panel. The height of the top slot is preferably between about 0.700" and about 1.4". More preferably, the height of the top slot is between about 0.950" and about 1.05". In one embodiment, the plurality of adjustable openings are based on a plurality of adjustable panels. Preferably, the width of the plurality of adjustable openings is between about 1" and about 8". Alternately, the width of the plurality of adjustable openings may be about 2" or greater. The length of each of the plurality of openings is preferably between about 16" and about 20". Alternately, the length of each of the plurality of openings may be about 10" or greater. The first and second panels may be included in a housing, wherein the housing is capable of passing about 1000 or more cubic feet of air per minute. More preferably, the housing is capable of passing about 1500 or more cubic feet of air per minute.

In some embodiments, the present invention further comprises a chamber surrounding the housing. The housing is preferably capable of maintaining a temperature differential of less than about 10° F. More preferably, the housing is capable of maintaining a temperature differential of less than about 5° F. In order to dry or cure a golf ball or golf ball component, the plurality of trays move through the housing at a rate of 3 feet per minute or less. More preferably, the plurality of trays move through the housing at a rate of 1 foot per minute or less.

In another embodiment, the present invention comprises a method for heating golf balls. The method comprises configuring and dimensioning a plurality of slots capable of passing air in a direction substantially parallel to a plurality of trays. The method also includes configuring and dimensioning a plurality of adjustable openings substantially perpendicular to the plurality of slots. Air may be provided in a direction substantially parallel to the plurality of trays.

In one embodiment, the width of the plurality of slots increases incrementally from a first end of a panel to a second end of a panel. The plurality of adjustable openings may be adjusted to vary the rate of air flow within a housing. The plurality of trays preferably move through the housing at a rate of about 3 feet per minute. More preferably, the plurality of trays move through the housing at a rate of about 1 foot per minute.

It may be desirable for the plurality of slots to be configured and dimensioned to adjust the temperature within the housing. Alternately, it may be desirable for the plurality of slots are configured and dimensioned to adjust the rate of air flow within the housing. The plurality of adjustable openings may also be configured and dimensioned to adjust the temperature within the housing.

Preferably, the length of the plurality of slots is between about 20" and about 30". More preferably, the length of the plurality of slots is between about 15" and about 35". In one embodiment, the plurality of slots includes a lowest slot disposed substantially near the first end of the panel. The height of the lowest slot is preferably between about 0.400" and about 0.600". More preferably, the height of the lowest slot is between about 0.520" and about 0.540". The plurality of slots may also include a top slot disposed substantially near the second end of the panel. The height of the top slot is preferably between about 0.700" and about 1.4". More preferably, the height of the top slot is between about 0.950" and about 1.05".

DETAILED DESCRIPTION OF THE PREFERRED EMBODIMENTS

Drying apparatus and methods are typically used in the golf ball manufacturing process in order to dry or cure golf balls. Prior art apparatus employed a housing through which golf balls pass. In these prior apparatus, heated air is preferably passed through the housing in order to dry or cure the balls. In many applications, it is desirable to have the housing heated evenly. In other words, it is preferable to have a substantially small heating differential between the top and bottom, or the front and back, of the housing. In addition, it is desirable to maintain a substantially constant airflow between the two sides of the housing.

The present invention provides an apparatus and method for achieving a consistent temperature for drying or curing golf balls positioned with a housing. In addition, the present invention is capable of providing a substantially uniform airflow over the golf balls. One advantage of the present invention is that the apparatus is capable of curing and drying a dense population of golf balls with improved speed. Another advantage of the present invention is that the consistency of curing from ball to ball across a large matrix of closely oriented golf balls is improved over prior art apparatus and methods. Additionally, the air flow within the housing of the present invention may be adjusted through the use of adjustable panels. In this manner, the temperature throughout the housing may be varied, or balanced, as desired.

In one embodiment, the present invention may be referred to as an "oven," or "dryer." Preferably, the airflow into the dryer enters the housing perpendicular to the front edge of a matrix of golf balls. This allows the air supply to be selectively positioned in the middle of the back panel of the housing, such that air may be directed to the bottom and the top of the housing in an even manner. In one embodiment, the air flows from a supply plenum and through a plurality of slots configured and dimensioned on one face of the housing. The air preferably passes though the slots and over the matrix of golf balls. The air is then drawn out of the housing based on a plurality of adjustable slots configured and dimensioned on an opposite face of the housing. The air may then be recirculated and recycled in order to continue the drying process.

The present invention may be used in any number of applications. Particularly, the present invention may be used for applications in which a heated environment is desired. In one embodiment, the present invention may be used to dry or cure a dense population of golf balls that have been painted. In this embodiment, the it is desirable to use the oven to cure the paint consistently and evenly. In reference to the term golf balls used below, it will be understood that golf ball components or other objects may be used according to the present invention.

FIG. 1A is a diagram showing one embodiment of the present invention. As shown in the FIG. 1A embodiment, the present invention comprises a housing through which golf balls may pass. It is desirable for the golf balls to be positioned in a holding device that is capable of holding a plurality of golf balls. The holding device, or tray, preferably holds the golf balls in a matrix tightly packs the golf balls such that the number of golf balls on a given tray is maximized. It may be desirable for each tray to include a plurality of perforations that allow air to pass in order to aid in the drying or curing process. In one embodiment, more than one tray of golf balls may fit inside the housing. Preferably, a plurality of trays may move through the housing. In one embodiment, a tray of golf balls enters from the bottom portion of the housing and is moved upwards at a desired speed. Preferably, the rate of motion of the tray is sufficiently slow to allow the golf balls to dry or cure.

In one embodiment, the housing includes front and back panels. The front and back panels may be connected by side panels in any desired manner. An air supply plenum is preferably operatively connected to the back panel such that it is capable of passing air through slots in the back panel. The air supply plenum is preferably positioned such that air flows into the slots in the panel in a substantially perpendicular direction. The air may then pass through the slots in the back panel and over the trays of golf balls. One advantage of positioning the supply plenum substantially perpendicular to the back panel is that the air may be more evenly distributed through each of the slots in the back panel compared to prior art apparatus. Another advantage is that the air may flow in a direction that is substantially parallel to the orientation of the trays. The air may be drawn out of the housing through a plurality of openings in the front panel of the housing. In one embodiment, it may be desirable to surround the housing within a chamber 2 such that air that flows out of the front panel of the housing may be recycled back to a heater and then re-supplied to the air supply plenum, as shown in FIG. 1A. In some embodiments, the chamber surrounding the housing may include an extraction device, such as an exhaust fan, absorbing agent, or the like that is capable of extracting harmful or unwanted vapors that result from the drying or curing process. The extraction device may preferably be disposed at the top of the housing.

In one embodiment, the housing and surrounding chamber may be made out of any material that is capable of being subjected to elevated temperatures without compromising its structural integrity. For example, in one embodiment the housing and chamber may comprise a metal, metallic alloy, plastic, and the like. Metals that may be used include steel, aluminum, titanium, and the like.

Figure 1B:
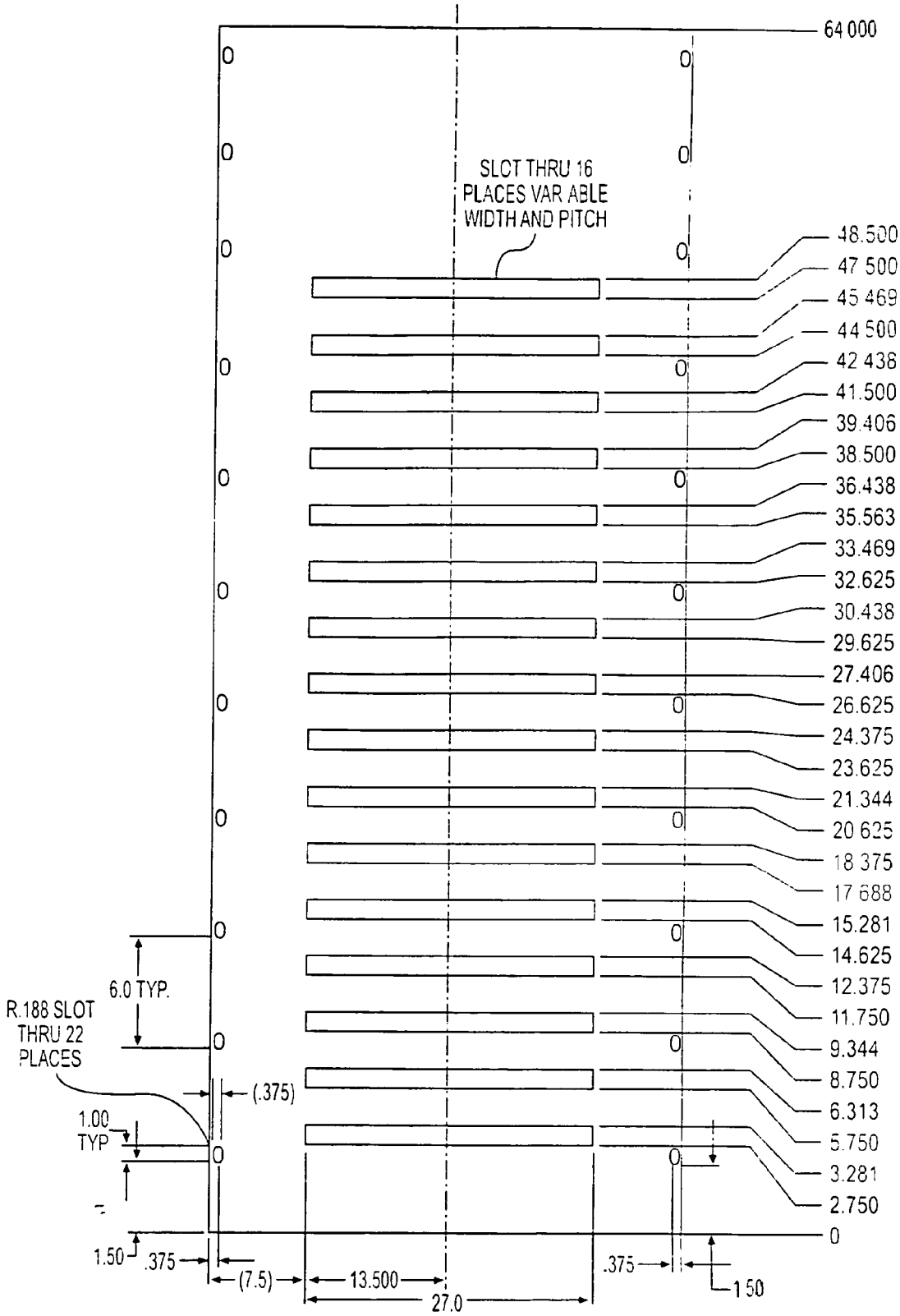
Figure 2:
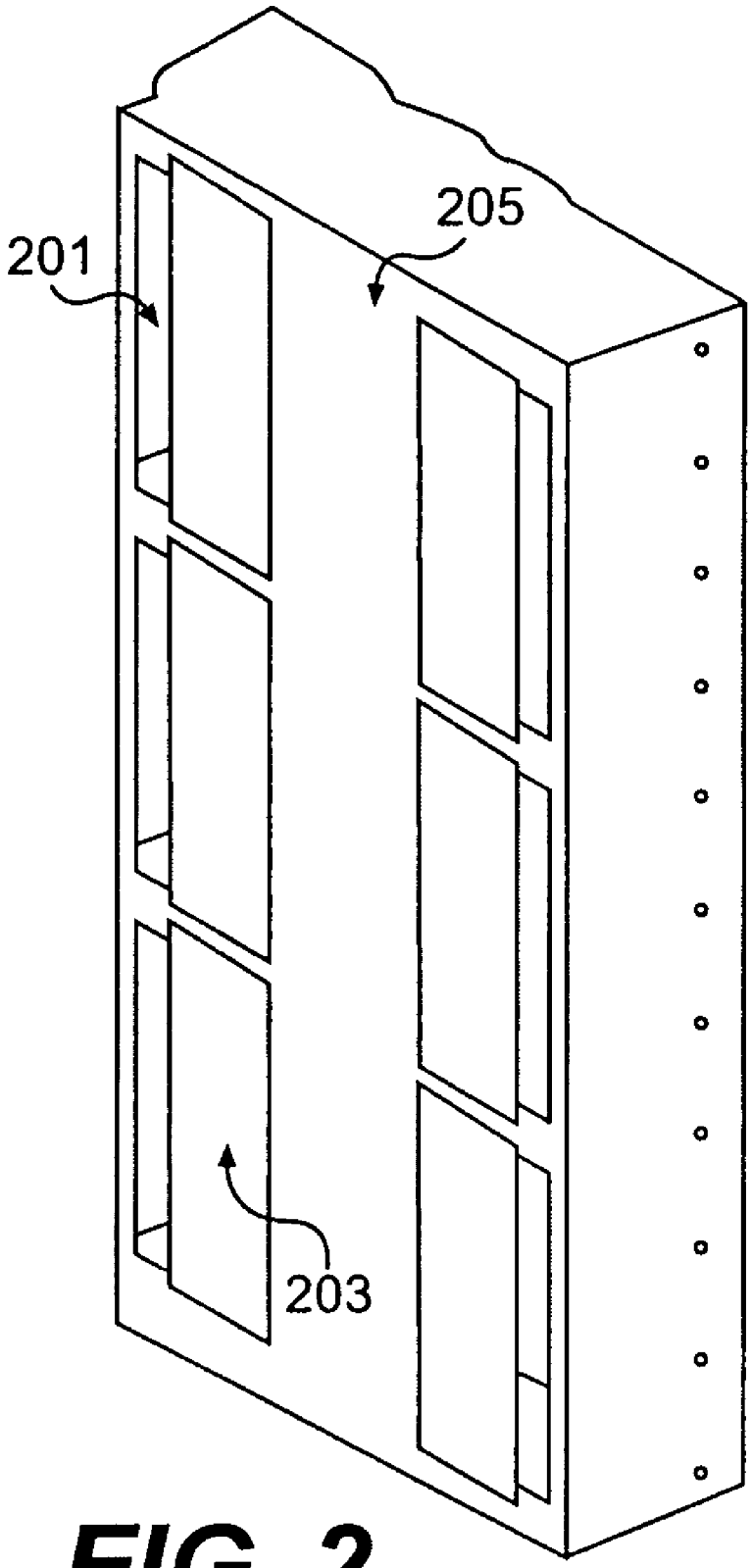
FIG. 2 is a diagram showing one embodiment of a front panel according to the present invention.

FIGS. 1B and 2 are diagrams showing one embodiment of the back and front panels of the housing, respectively. As shown in FIG. 1B, the back panel comprises a plurality of slots through which air may flow. In one embodiment, it may be desirable to vary the height of each opening in order to manipulate the air flow. For instance, in many prior art apparatus, it is common for the lower portion of the housing to have a lower temperature than the upper portion. However, this may be undesirable because the temperature differential causes the golf balls to dry or cure unevenly. Thus, it may be desirable to increase the rate of air flow to compensate for the decreased temperature. In one embodiment of the present invention, the height of each of the slots may be varied to substantially minimize the temperature differential between the lower and upper portions of the housing. In addition, the height of each of the slots may be varied in order to increase the rate of air flow through the bottom portion of the housing.

For example, in one embodiment the height of the slots in the lower portion of the back panel is smaller than the height of the slots in the upper portion. One advantage of having smaller slots in the lower portion of the back panel is that a smaller volume of air may pass through them. Thus, more air from the supply plenum will be forced through the upper slots, which may aid in reducing the temperature differential discussed above. Another advantage of having smaller slots in the lower portion of the back panel may be that the velocity of the air that passes over the entering trays of balls may be increased. This may be desirable, for example, in order to increase the rate of drying or curing towards the bottom of the housing where the temperature may be the lowest.

In one embodiment, the height of the lowest slot may be between about 0.400" and about 0.600". More preferably, the height of the lowest slot may be between about 0.500" and about 0.560". Most preferably, the height of the lowest slot may be between about 0.520" and about 0.540". The height of the top slot may be similarly varied. Preferably, the height of the top slot is between about 0.700" and about 1.4". More preferably, the height of the top slot may be between about 0.900" and about 1.2". Most preferably, the height of the top slot may be between about 0.950" and about 1.05". The height of the slots in between the top and bottom slots may be varied such that their heights increase incrementally from bottom to top. Preferably, the height of each of the slots in between the top and bottom slots is between the ranges described above.

In some embodiments, the length of the slots may also be varied. The length may be varied according to, for example, the size of the back panel. For instance, in embodiments where large trays of golf balls are used, it may be desirable to increase the length of the slots. Similarly, in embodiments where smaller trays of golf balls are used, it may be desirable to reduce the length of the slots. It may also be desirable to vary the length of the slots incrementally from bottom to top as desired. However, in one embodiment each of the plurality of slots in the back panel may have substantially similar lengths. The length of each slot is preferably between about 15" and about 35". More preferably, the length of each slot may be between about 20" and about 30". Most preferably, the length of each slot may be between about 26" and about 28". In another embodiment, the length of each slot may be about 20" or greater. More preferably, the length of each slot may be about 25" or greater, and most preferably the length of each slot may be about 30" or greater.

The distance between adjacent slots may also be varied. As described herein, the distance between adjacent slots may be measured by the distance between the top of one slot and the bottom of a slot directly adjacent to, and above it. The distance between adjacent slots may be varied in order to achieve an even temperature distribution within the housing. Alternately, the distance between adjacent slots may be varied to manipulate the rate, or volume of air that flows to a desired portion of the housing. Positioning adjacent slots closely may allow more air to flow to a desired portion of the housing while reducing air flow to other portions. For example, in some embodiments it may be desirable to increase the volume of air to the upper portion of the housing in order to achieve an even temperature distribution within the housing. However, in other embodiments it may be desirable to create a temperature differential within the housing. One way to achieve an even temperature distribution or a temperature differential may be by selectively spacing adjacent slots. In addition, as described above the height of the slots near the upper portion of the panel are preferably greater than the height of the lower slots. Thus, the velocity of air that passes through the upper slots may be lower than the velocity of air that passes through the lower slots. Thus, decreasing the distance between adjacent upper slots may compensate for the lower velocity by increasing the volume of air that passes through the upper slots.

In one embodiment, the distance between adjacent slots may be decreased from bottom to top in order to achieve an even temperature distribution within the housing. Preferably, the distance between the two lowest adjacent slots may be between about 2" and about 3". More preferably, the distance between the two lowest adjacent slots may be between about 2.2" and about 2.6". Most preferably, the distance between the two lowest adjacent slots may be between about 2.4" and about 2.5". In one embodiment, the distance between the two uppermost adjacent slots may be between about 1.5" and about 2.5". More preferably, the distance between the two uppermost adjacent slots may be between about 1.8" and about 2.2". Most preferably, the distance between the two uppermost adjacent slots may be between about 1.9" and about 2.1".

In other embodiments, however, adjacent slots may be evenly spaced from bottom to top. One advantage of evenly spacing adjacent slots may be that the complexity of determining the amount of air flowing into the housing may be reduced. In other words, by maintaining a constant spacing between adjacent slots and a fixed length for each slot, the air flow to particular portions of the housing may be calculated based only on the varied height of the slots.

After air passes through the back panel, it may pass over the trays of golf balls positioned within the housing. The air may then be drawn out of the housing through the front panel. FIG. 2 is a diagram showing one embodiment of the front panel. In one embodiment, the front panel comprises a plurality of openings 201 through which air may flow out of the housing. Though the size of the openings is preferably fixed, the amount of air permitted to pass through them may be varied based on a plurality of adjustable panels 203. The panels 203 are preferably configured and dimensioned such that they are capable of completely preventing air from passing through the openings 201. The panels 203 are preferably also capable of moving such that they are capable of allowing the opening 201 to be unobstructed. Preferably, the panels 203 are selectively positioned such that they may be manually or automatically moved to vary the size of the opening 201.

Figure 3:
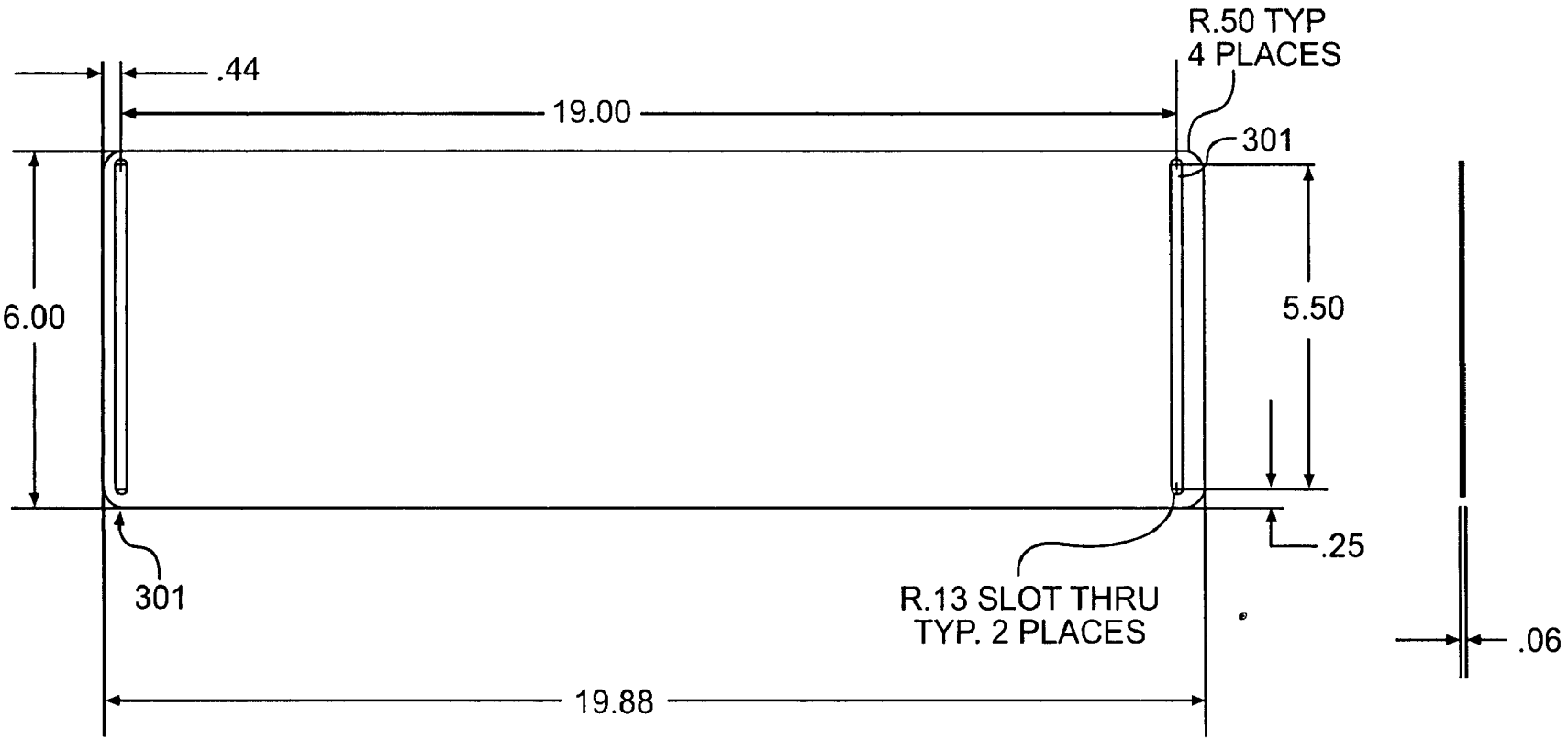
FIG. 3 is a diagram showing one embodiment of an adjustable panel according to the present invention.
Figure 4:
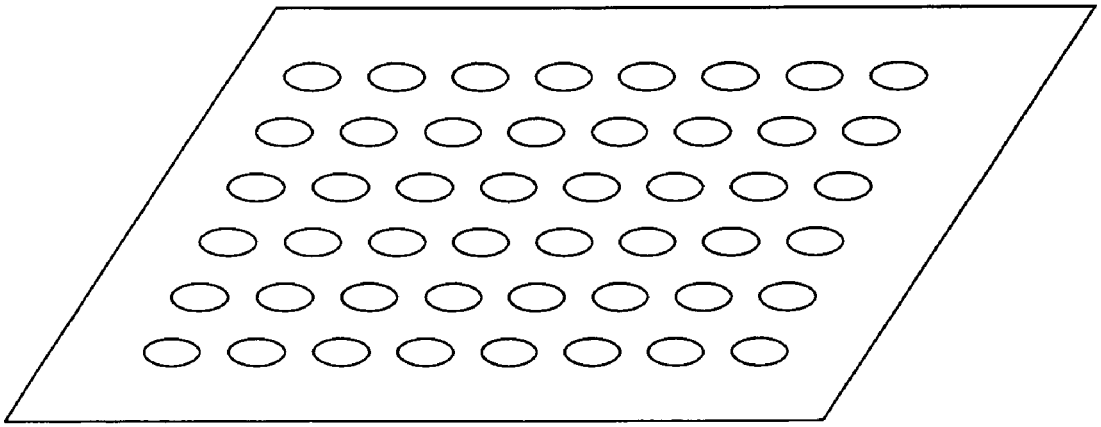
FIG. 4 is a diagram showing a tray according to one embodiment of the present invention.
Figure 5:
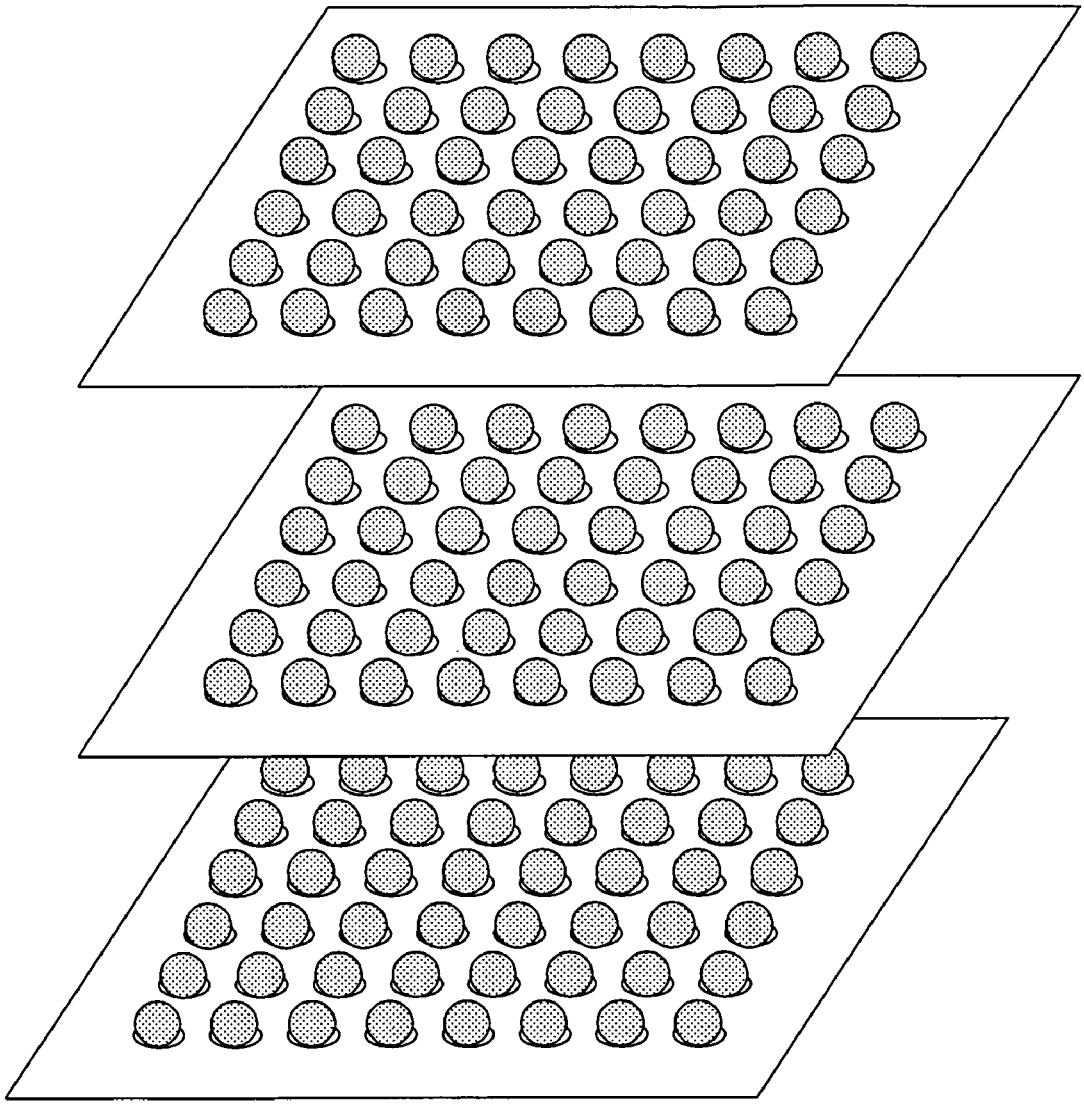
FIG. 5 is a diagram showing a plurality of trays containing golf ball matrices according to one embodiment of the invention.

In one embodiment, the panels 203 may include one or more slots that are capable of slidingly engaging with a fastener, such as a screw, bolt, and the like. It may be desirable to position a slot 301 at the top and bottom of each of the panels 203, as shown in FIG. 3. Preferably, the slotted panel 203 may be slidingly engaged with the fastener to vary the size of the opening 201. One advantage of varying the size of the opening 201 is that the air flow within the housing may be manipulated. Another advantage of varying the size of the opening 201 is that the temperature within the housing may be controlled, as mentioned above.

In one embodiment, the front panel preferably comprises a plurality of openings 201. The openings 201 may be selectively positioned on the face of the panel 205. Additionally, in some embodiments a plurality of openings may also be selectively positioned on the side of the front panel. Preferably, the number of openings 201 may be about 4 or greater. More preferably, the number of openings may be about 10 or greater. Most preferably, the number of openings may be about 20 or greater.

In one embodiment, the dimensions of each of the plurality of openings is preferably substantially similar. Preferably, the width of each of the openings is between about 1" and about 8". More preferably, the width of each of the openings 201 is between about 2" and about 6", and most preferably the width of each of the openings is between about 3.5" and about 4.5". In another embodiment, the width of each of the openings 201 may be about 2" or greater. More preferably, the width of each of the openings may be about 4" or greater, and most preferably the width of each of the openings may be about 6" or greater.

The length of each of the openings may also be varied. Preferably, the length of each of the openings 201 may be between about 10" and about 30". More preferably, the length of each of the openings 201 may be between about 12" and about 25". Most preferably, the length of each of the openings 201 may be between about 16" and about 20". Alternately, the length of each of the openings 201 may be about 10" or greater. More preferably, the length of each of the openings 201 may be about 15" or greater, and most preferably the length of each of the openings 201 may be about 20" or greater.

In one embodiment, the size of the openings 201 may be adjusted in order to substantially reduce the temperature differential between the bottom and upper portions of the housing. Preferably, the present invention is capable of maintaining a temperature differential between the bottom and upper portion of the housing of less than about 10° F. More preferably, the present invention is capable of maintaining a temperature differential between the bottom and upper portion of the housing of less than about 5° F.

As mentioned above, the housing is preferably configured and dimensioned such that a plurality of trays of golf balls may pass through it. Preferably, the plurality of trays are positioned substantially perpendicular to the back and front panels and move vertically from the bottom portion of the housing to the upper portion of the housing. In one embodiment, each of the trays comprises a staggered matrix of golf balls. Having a staggered matrix of golf balls allows golf balls to be tightly packed so that the number of golf balls per tray may be maximized.

Positioning the golf balls along the same even lines would require the tray to be bigger to hold the same number of golf balls. However, because of the spherical nature of the balls, staggering the balls allows more to be packed in a given area. One advantage of increasing the number of golf balls per tray is that an increased number of golf balls may be moved through the housing compared to a sparsely populated tray. Preferably, each tray is capable of holding more than about 100 golf balls. More preferably, each tray is capable of holding more than about 200 golf balls, and most preferably each tray is capable of holding more than about 300 golf balls. In another embodiment, each tray may be capable of holding golf balls or golf ball components in an arrangement of 10×8 or greater. More preferably, each tray may be capable of holding golf balls or golf ball components in an arrangement of 13×10 or greater. Most preferably, each tray may be capable of holding golf balls or golf ball components in an arrangement of about 16×14 or greater.

The dimensions of the housing may be varied as desired. In some embodiments, the dimensions of the housing may be varied according to a number of factors, such as air velocity, economic considerations, and the like. In one embodiment, the dimensions of the housing may be chosen such that about 20 or more trays of golf balls or golf ball components may fit inside at any given time. More preferably, the dimensions may be chosen such that about 30 or more trays may fit inside at any given time. Most preferably, the dimension may be chosen such that about 40 or more trays may fit inside at any given time.

Each tray of golf balls or golf ball components may be capable of being moved automatically from the bottom portion of the housing to the upper portion of the housing. In one embodiment, each tray moves at substantially the same rate through the housing. Preferably, the rate of movement of each tray is about 3 feet per minute or less. More preferably, the rate of movement of each tray is about 1 foot per minute or less.

The dimensions of the housing may be chosen such that the housing is capable of accommodating a large number of golf balls. One way to describe the drying or curing ability of the housing is according to the number of golf balls that may be dried or cured inside the housing. For example, the housing is preferably configured and dimensioned such that about 3000 or more golf balls may be cured or dried in about 50 cubic feet or less of the housing. More preferably, about 4500 or more golf balls may be cured or dried in about 50 cubic feet or less of the housing. Most preferably, about 5500 or more golf balls may be cured or dried in about 50 cubic feet or less of the housing. Alternately, about 150 or more golf balls may be cured or dried in about 2 cubic feet or less of the housing. More preferably, about 200 or more golf balls may be cured or dried in about 2 cubic feet or less, and most preferably about 300 or more golf balls may be cured or dried in about 2 cubic feet or less of the housing. Another way to describe the ability of the present invention to cure or dry golf balls or golf ball components is according to the volume of air that is capable of being passed through the housing per unit of time. Preferably, the present invention is capable of blowing about 1000 or more cubic feet of air per minute through the housing. More preferably, the present invention is capable of blowing about 1500 or more cubic feet of air per minute, and most preferably the present invention is capable of blowing about 2000 or more cubic feet of air per minute through the housing.

Another way to describe the drying or curing ability of the present invention is by the number of balls that may be dried or cured during a given period of time. Preferably, balls may be dried at a rate of about 100 or more every five minutes. More preferably, balls may be dried or cured at a rate of about 500 or more every five minutes. Most preferably, balls may be dried or cured at a rate of about 1000 or more every five minutes.

As mentioned above, the air that enters the housing may be heated in order to increase the rate of curing or drying of a golf ball or golf ball component. Any heating device or method known to those skilled in the art may be used. The heating element is preferably operatively connected to the air supply plenum to heat the air before it enters through the slots in the back panel. Preferably, the heater is capable of heating the air to about 80° F. or greater. More preferably, the heater is capable of heating the air to about 150° F. or greater, and most preferably the heater is capable of heating the air to about 200° F. or greater.

In one embodiment, air is heated and then forced into the air supply plenum. It is desirable for the air supply plenum to be operatively connected to the back panel such that substantially all of the air from the supply plenum passes through the slots on the back panel. As air passes through the slots on the back panel, it is forced over the trays of golf balls or golf ball components. The air then exits through the openings 201 on the front panel. As described in detail above, the dimensions of the slots on the back panel and the openings 201 on the front panel may be configured and dimensioned such that a desired air flow and temperature differential may be achieved. As air passes through the openings 201 on the front panel, the air may then be captured by a chamber. The chamber may be capable of drawing the air back towards the heater such that it is capable of being recycled, heated, and then re-supplied by the air supply plenum, as shown in FIG. 1A. At substantially the same time as air is being circulated through the housing, the trays of golf balls may move through the housing at a desired rate. Preferably, the trays move from the bottom portion of the housing to the top portion of the housing. After leaving the housing, the trays may be moved to another location for further processing.

Although the present invention has been described with reference to particular embodiments, it will be understood to those skilled in the art that the invention is capable of a variety of alternative embodiments within the spirit of the appended claims.

The invention claimed is:

1. An apparatus for heating golf balls comprising:

a housing comprising:

a bottom portion;

an upper portion;

back panel comprising a plurality of horizontal slots, wherein the height of the slots increases incrementally from a bottom end of the back panel to a top end of the back panel;

a front panel comprising a plurality of air inlet openings wherein the size of the openings is adjustable; and side panels connecting the front and back panels;

an air supply operable to provide air in a direction substantially perpendicular to the back panel;

a plurality of trays, which enter the oven at the bottom portion and are positioned substantially perpendicular to the front and back panels, wherein the apparatus is configured to move the plurality of trays automatically from the bottom portion to the upper portion, where the trays exit.

2. The apparatus according to claim 1, wherein the plurality of slots are substantially parallel to a plurality of trays.

3. The apparatus according to claim 1, wherein the length of the plurality of slots is about 20" or greater.

4. The apparatus according to claim 1, wherein the length of the plurality of slots is about 25" or greater.

5. The apparatus according to claim 1, wherein the plurality of slots includes a lowest slot located substantially near the bottom end of the back panel, and wherein the height of the lowest slot is between about 0.400" and about 0.600".

6. The apparatus according to claim 5, wherein the height of the lowest slot is between about 0.500" and about 0.560".

7. The apparatus according to claim 1, wherein the plurality of slots includes a top slot positioned substantially near the top end of the back panel, wherein the height of the top slot is between about 0.700" and about 1.4".

8. The apparatus according to claim 7, wherein the height of the top slot is between about 0.900" and about 1.2".

9. The apparatus according to claim 1, wherein the size of the plurality of openings are adjustable based on a plurality of adjustable panels.

10. The apparatus according to claim 1, wherein the width of the plurality of openings is between about 1" and about 8".

11. The apparatus according to claim 1, wherein the width of the plurality of openings is about 3" or greater.

12. The apparatus according to claim 1, wherein the length of each of the plurality of openings is between about 12" and about 25".

13. The apparatus according to claim 1, wherein the length of each of the plurality of openings is about 15" or greater.

14. The apparatus according to claim 1, wherein the housing is operable to pass about 1000 or more cubic feet of air per minute.

15. The apparatus according to claim 14, wherein the housing is operable to provide about 1500 or more cubic feet of air per minute.

16. The apparatus according to claim 1, wherein the plurality of openings is substantially perpendicular to the plurality of slots.

17. The apparatus according to claim 1, wherein the apparatus is capable of curing or drying about 3000 or more golf balls in about 50 cubic feet of the housing.

18. The apparatus according to claim 14, further comprising a chamber surrounding the housing.

19. An apparatus for heating golf balls, comprising:

a first panel comprising a plurality of horizontal slots substantially parallel to a plurality of trays, wherein the height of the plurality of slots increases incrementally from a bottom end of the first panel to a top end of the first panel;

a second panel comprising a plurality of adjustable air inlet openings substantially perpendicular to the plurality of slots; and an air supply operable to provide air in a direction substantially perpendicular to the first panel, wherein the apparatus is capable of curing about 150 or more golf balls in about 2 cubic feet or less; and wherein the apparatus is configured to automatically move the trays vertically from a bottom portion of the apparatus to a top portion of the apparatus.

20. The apparatus according to claim 19, wherein the length of the plurality of slots is between about 20" and about 30".

21. The apparatus according to claim 19, wherein the length of the plurality of slots is between about 15" and about 35".

22. The apparatus according to claim 19, wherein the plurality of slots includes a lowest slot positioned substantially near the bottom end of the first panel, wherein the height of the lowest slot is between about 0.400" and about 0.600".

23. The apparatus according to claim 22, wherein the height of the lowest slot is between about 0.520" and about 0.540".

24. The apparatus according to claim 19, wherein the plurality of slots includes a top slot positioned near the top end of the first panel, wherein the height of the top slot is between about 0.700" and about 1.4".

25. The apparatus according to claim 24, wherein the height of the top slot is between about 0.950" and about 1.05".

26. The apparatus according to claim 19, wherein the plurality of adjustable openings are based on a plurality of adjustable panels.

27. The apparatus according to claim 19, wherein the width of the plurality of adjustable openings is between about 1" and about 8".

28. The apparatus according to claim 19, wherein the width of the plurality of adjustable openings is about 2" or greater.

29. The apparatus according to claim 19, wherein the length of each of the plurality of openings is between about 16" and about 20".

30. The apparatus according to claim 19, wherein the length of each of the plurality of openings is about 10" or greater.

31. The apparatus according to claim 19, wherein the first and second panel are included in a housing, wherein the housing is operable to pass about 1000 or more cubic feet of air per minute.

32. The apparatus according to claim 31, wherein the housing is operable to pass about 1500 or more cubic feet of air per minute.

33. The apparatus according to claim 31, further comprising a chamber surrounding the housing.

34. The apparatus according to claim 31, wherein the housing is operable to maintain a temperature differential of less than about 10° F.

35. The apparatus according to claim 31, wherein the housing is operable to maintain a temperature differential of less than about 5° F.

36. The apparatus according to claim 31, wherein each tray in the plurality of trays move through the housing at a rate of 3 feet per minute or less.

37. The apparatus according to claim 31, wherein each tray in the plurality of trays move through the housing at a rate of 1 foot per minute or less.

38. A method for heating golf balls, comprising:

configuring and dimensioning a housing comprising:

a bottom portion;

a top portion;

a plurality of trays;

a first side panel comprising a plurality of slots operable to pass air in a direction substantially parallel to the plurality of horizontal trays;

a second side panel comprising a plurality of adjustable air inlet openings substantially perpendicular to the plurality of slots, wherein the housing is configured to automatically move the plurality of trays vertically from the bottom portion to the upper portion;

loading golf balls onto the plurality of trays; causing the trays to enter the oven at the bottom portion;

providing the air in a direction substantially parallel to the plurality of trays; and drying about 150 or more golf balls in about 2 cubic feet or less of the housing; causing the trays to exit at the top portion.

39. The method according to claim 38, wherein the height of the plurality of slots increases incrementally from a bottom end of the first side panel to a top end of the first side panel.

40. The method according to claim 38, wherein the plurality of adjustable openings are adjusted to vary the rate of air flow within the housing.

41. The method according to claim 40, wherein the plurality of trays move through the housing at a rate of about 3 feet per minute.

42. The method according to claim 40, wherein the plurality of trays move through the housing at a rate of about 1 foot per minute.

43. The method according to claim 40, wherein the plurality of slots are configured and dimensioned to adjust the temperature within the housing.

44. The method according to claim 40, wherein the plurality of slots are configured and dimensioned to adjust the rate of air flow within the housing.

45. The method according to claim 40, wherein the plurality of adjustable openings are configured and dimensioned to adjust the temperature within the housing.

46. The method according to claim 38, wherein the length of the plurality of slots is between about 20" and about 30".

47. The method according to claim 38, wherein the length of the plurality of slots is between about 15" and about 35".

48. The method according to claim 39, wherein the plurality of slots includes a lowest slot disposed substantially near the bottom end of the first side panel, and wherein the height of the lowest slot is between about 0.400" and about 0.600".

49. The method according to claim 48, wherein the height of the lowest slot is between about 0.520" and about 0.540".

50. The method according to claim 39, wherein the plurality of slots includes a top slot disposed substantially near the top end of the first side panel, and wherein the height of the top slot is between about 0.700" and about 1.4".

51. The method according to claim 50, wherein the height of the top slot is between about 0.950" and about 1.05".

52. The apparatus according to claim 1, wherein each tray comprises a plurality of perforations.

53. The apparatus according to claim 19, wherein each tray comprises a plurality of perforations.

54. The method according to claim 38, wherein each tray comprises a plurality of perforations.

55. The apparatus according to claim 1, wherein each tray comprises a staggered matrix of golf balls.

56. The apparatus according to claim 19, wherein each tray comprises a staggered matrix of golf balls.

57. The method according to claim 38, wherein the step of loading comprises loading a staggered matrix of golf balls onto the plurality of trays.

* * * * *